US005854648A

United States Patent [19]

Hanabusa

[11] Patent Number: 5,854,648

[45] Date of Patent: Dec. 29, 1998

[54] INK JET RECORDING METHOD AND APPARATUS

[75] Inventor: Tadashi Hanabusa, Kawasaki, Japan

[73] Assignee: Canon Kabushiki Kaisha, Tokyo, Japan

[21] Appl. No.: 801,423

[22] Filed: Feb. 18, 1997

Related U.S. Application Data

[63] Continuation of Ser. No. 738,629, Jul. 31, 1991, abandoned.

[30] Foreign Application Priority Data

Aug. 2, 1990 [JP] Japan ..... 2-205851

[51] Int. Cl.[6] ..... B41J 2/01; B41J 11/02

[52] U.S. Cl. ..... 347/104; 347/3

[58] Field of Search ..... 347/104, 3, 55

[56] References Cited

U.S. PATENT DOCUMENTS

| | | | |
|---|---|---|---|
| 3,848,258 | 11/1974 | Mahoney | 347/55 |
| 4,313,124 | 1/1982 | Hara | 347/57 |
| 4,345,262 | 8/1982 | Shirato et al. | 347/56 X |
| 4,442,439 | 4/1984 | Mizuno | 347/104 X |
| 4,459,600 | 7/1984 | Sato et al. | 347/56 X |
| 4,463,359 | 7/1984 | Ayata et al. | 347/86 |
| 4,558,333 | 12/1985 | Sugitani et al. | 347/65 |
| 4,668,960 | 5/1987 | Okamura | 347/104 X |
| 4,723,129 | 2/1988 | Endo et al. | 347/56 |
| 4,729,557 | 3/1988 | Kiyohara | 347/104 X |
| 4,740,796 | 4/1988 | Endo et al. | 347/56 |
| 4,805,067 | 2/1989 | Amarakoon | 361/214 X |
| 4,843,338 | 6/1989 | Rasmussen et al. | 347/8 |
| 5,019,840 | 5/1991 | Watanabe et al. | 346/136 X |
| 5,102,247 | 4/1992 | Nagoshi | 347/104 X |
| 5,136,307 | 8/1992 | Uchida et al. | 347/104 X |

FOREIGN PATENT DOCUMENTS

| | | | |
|---|---|---|---|
| 54-56847 | 5/1979 | Japan | B41M 5/26 |
| 59-123670 | 7/1984 | Japan | B41J 3/04 |
| 59-138461 | 8/1984 | Japan | B41J 3/04 |
| 60-71260 | 4/1985 | Japan | B41J 3/04 |
| 0164870 | 7/1986 | Japan | B41J 13/00 |
| 0193857 | 8/1987 | Japan | B41J 11/04 |
| 0282040 | 11/1988 | Japan | B41J 15/16 |
| 0303780 | 12/1988 | Japan | B41J 13/02 |
| 0011375 | 1/1990 | Japan . | |

*Primary Examiner*—Joseph W. Hartary
*Attorney, Agent, or Firm*—Fitzpatrick, Cella, Harper & Scinto

[57] ABSTRACT

An ink jet recording apparatus for recording on a recording medium by discharging comprise a conveyor for conveying the recording medium to a position opposed to an ink discharge portion of a recording head for discharging the ink, the conveyor having a conveying roller for conveying the recording medium, a paper presser bar provided to be able to abut on the conveying roller, a conveyance passage forming member for forming a conveyance passage of the recording medium, and an electrical conductive member provided opposed to a back portion of a face opposed to the ink discharge portion of the recording medium conveyed by said conveying means. The electrical conductive member is held at a potential lower than that of the charged recording medium opposed thereto.

21 Claims, 8 Drawing Sheets

202
DISPLAY
203
TOUCH PANEL
204
FM SOUND SOURCE
205
SPEAKER
206
PRINTER
207
IMAGE READER
208
FAX TRANSMITTING/ RECEIVING
209
TELEPHONE
201
CPU
210
MEMORY
ROM
RAM
211
KEY BOARD
212
EXTERNAL MEMORY DEVICE

INK JET RECORDING METHOD AND APPARATUS

This application is a continuation of application Ser. No. 07/738,629, filed Jul. 31, 1991, now abandoned.

BACKGROUND OF THE INVENTION

1. Field of the Invention

The present invention relates to an ink jet recording method and an ink jet recording apparatus for recording by discharging the ink to form liquid droplets and to adhere them onto a recording medium such as a paper or the like.

Here, the ink jet recording apparatus according to the present invention is applicable to office or communication equipment such as an electronic typewriter, word processor, copying machine, facsimile terminal equipment or computer.

2. Related Background Art

Conventionally, the recording apparatus for recording onto a recording medium such as a paper or OHP sheet (thereafter referred to as a recording sheet or simply as a paper) has been proposed in the form of mounting a recording head thereon in various recording methods. There are such recording heads based on wire-dot, thermal, thermal imprint, or ink jet recording method.

Among them, particularly the ink jet recording method is one in which the ink is directly discharged onto a recording sheet, and has been noted by virtue of its inexpensive running cost and quiet recording.

Also, recently, in ink jet recording apparatuses, particularly, recording head manufacture is made with a film creation technology or a micro process technology in semiconductor devices to realize smaller and more inexpensive recording heads. Thus, for example, a disposable-type recording head formed integrally with an ink tank has been proposed, and consequently the constitution of the apparatus itself is made smaller and simpler.

On the other hand, the ink jet recording apparatus having various advantages as above described is widely used as a recording apparatus for various equipments such as an electronic typewriter, word processor, facsimile terminal equipment, copying machine, etc. In this case, the ink jet recording apparatus comprises a configuration corresponding to the functions or usage forms specific to such equipment.

Also, from the viewpoint of popularity, an electronic typewriter or word processor should tend to be smaller and lighter, portable, and less expensive, and from that aspect, it is desired that the ink jet recording apparatus for use with such an equipment may have a smaller, simpler, and less expensive constitution.

One tendency of recent ink jet recording apparatuses as above described, i.e., smaller and simpler apparatuses, requires that the components themselves constituting the ink jet recording apparatus or the mechanisms associating therewith each of those components should be simplified.

Among those components or mechanisms, a mechanism for conveying a recording medium may demand a relatively large space for the disposition within the recording apparatus, and with the simplification of this mechanism, the apparatus can be effectively made smaller. Especially, among this conveying mechanism, for example, an urging mechanism for pressing means for conveying the recording medium, e.g., a conveying roller or paper exhausting roller to yield a conveying force (frictional force) between such means and the recording medium, and a mechanism for forming a conveyance passage of the recording medium, may occupy a main portion of conveying mechanism. As the urging mechanism among them, there are provided a feed roller and a paper presser bar for pressing the conveying roller, and a spur for pressing the paper exhausting roller, while as the mechanism forming the conveyance passage, there is provided a paper pan.

However, though the apparatus can be made smaller with the simplification of the conveying or urging mechanism as above described, and the ink jet recording apparatus is constituted corresponding to the usage form as the output device for various equipments, another problem may arise.

For example, since the paper presser bar as the urging mechanism must cope with various paper qualities of recording medium, particularly various thicknesses of paper, and from the viewpoint of cost and processibility, as its material, mainly a resin, for example, polyacetal (POM) is often used. Also, as to the paper pan, for the reason of a lower cost and processibility on the fabrication, as its material, for example, polycarbonate (PC) is often used.

Due to the above material of the paper presser bar, when the recording medium is conveyed, friction will occur between the recording medium and the paper pan, or between the recording medium and the paper presser, so that the recording medium may be sometimes charged with static electricity. Also, it is thought, for example, that with a smaller configuration of the recording apparatus, the radius of curvature for the conveyance passage formed by the paper pan becomes relatively small, thereby easily yielding friction between the recording medium and the conveyance passage, so that the recording medium may be charged with static electricity.

If the recording is performed onto the recording medium in such a state, discharged ink droplets are bent in the flying direction, not impinging on predetermined positions on the recording medium, so that the recording positions may be disordered. In such a case, recorded characters or images may be recorded as improper shapes, thereby causing irregularities of density.

Of course, the above charging problem with the recording medium will not occur only in the smaller sized recording apparatus as above described, but it can become a problem for the ink jet recording apparatus that is more widely considered, even if the degree of charging may be varied.

SUMMARY OF THE INVENTION

The present invention was invented based on the above related art, and from a new viewpoint which was not conventionally foreseen.

Also, the present invention was fulfilled to resolve the above problem, wherein it is an object of the invention to provide an ink jet recording method and an apparatus therewith which can record a high quality image by making the flying of ink droplets stable and avoiding improper shapes of characters or images due to disordered recording positions, or irregularities of density.

Also, another object of the present invention is to provide an ink jet recording apparatus for recording onto a recording medium by discharging the ink, comprising:

conveying means for conveying said recording medium to a position opposed to an ink discharge portion of a recording head for discharging the ink, while being in contact with said recording medium; and an electrical conductive member positioned in proximity of said ink discharge portion, wherein the potential of said electrical conductive member is held at a reference voltage for said ink jet recording apparatus.

Further, another object of the present invention is to provide an ink jet recording method for recording onto a recording medium by discharging the ink, including the steps of:

positioning in a proximity relation an ink discharge portion of a recording head and an electrical conductive member the potential of which is maintained at a reference voltage of an ink jet recording apparatus; and recording by discharging the ink from said recording head onto said recording medium.

With the above constitution, for example, by electrically grounding a platen on a back side of a recording medium opposed to a discharge portion of the recording head to be maintained at a relatively low voltage, the flying of discharged ink is made stabler, and disordered recording positions on the recording medium with the ink can be avoided. Note that in this specification, the "platen" is provided on a position opposed to an ink discharge portion of the recording head to define a recording face of recording medium, and has the function as a guide member, with its shape being not limited to those as described in examples.

DETAILED DESCRIPTION OF THE PREFERRED EMBODIMENTS

An example of the present invention will be described in detail with reference to the drawings.

Figure 1A:
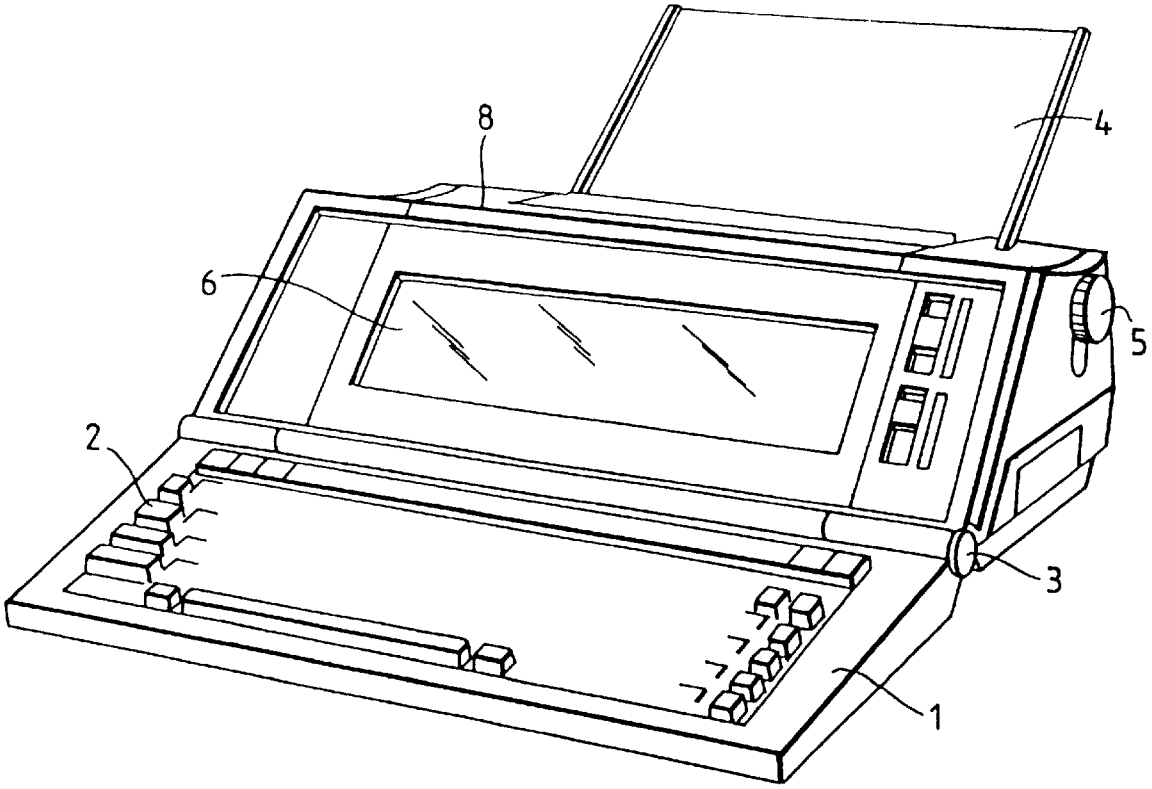
FIGS. 1A and 1B are external perspective views of an electronic typewriter as the apparatus in one example of the present invention, when in use and storage, respectively.
Figure 1B:
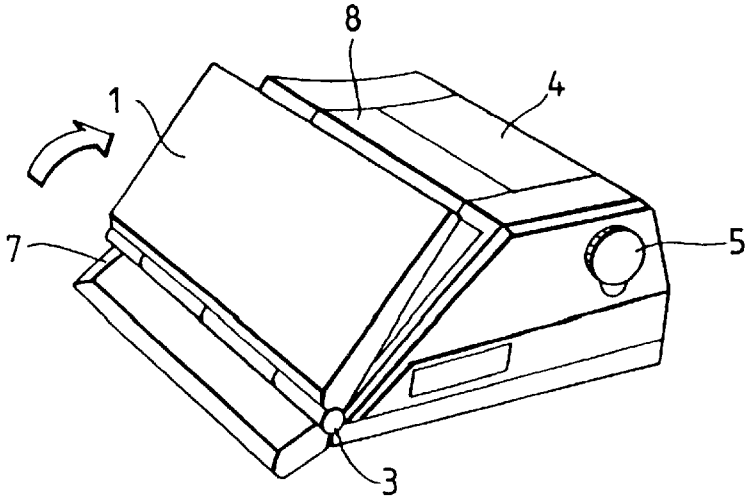

FIGS. 1A and 1B show a perspective view of an electronic typewriter as the apparatus to which the present invention is applicable.

Here, 1 is a keyboard section in which is arranged a group of keys 2, such as keys for entering characters, e.g. letters and numerals, or control keys. When not used, the keyboard section 1 can be folded by turning it around a hinge 3. Reference numeral 4 is a paper feed tray for feeding a sheet-like recording medium to a printer section within the apparatus, and can be also stored by folding it over the printer section, when not used, as shown FIG. 1B. Numeral 5 is a feeder knob for setting or exhausting the recording medium manually, 6 is a display for displaying input texts, and 7 is a handle useful for transporting the apparatus of this example.

Numeral 8 is a cover of the electronic typewriter in this example, for covering a window provided on an upper portion of the typewriter adjacent to the display 6, through which an ink jet printer stored therein and a recording sheet can be seen as will be described later.

Figure 2:
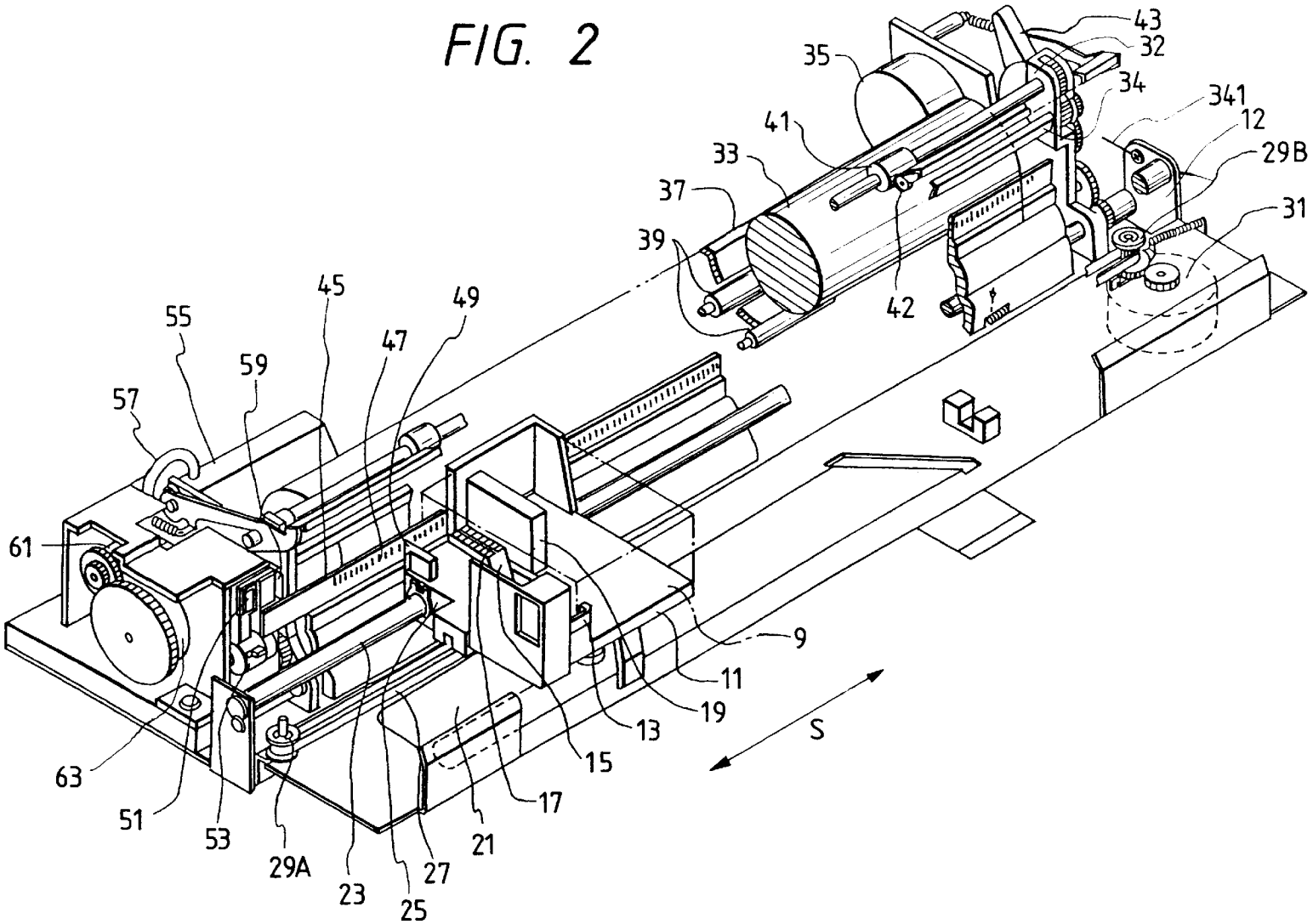
FIG. 2 is a perspective view showing one constitutional example of a printer to which the present invention is applicable.

FIG. 2 shows a constitutional example of a printer section of this example.

Here, 9 is a head cartridge having an ink jet recording head, and 11 is a carriage for scanning in the S direction as shown, with the head cartridge 9 mounted thereon. Numeral 13 is a hook for mounting the head cartridge 9 onto the carriage 11, and 15 is a level for operating the hook 13. On this level 15 is provided a marker 17 for enabling a print position or a set position of the recording head in the head cartridge to be read with the indication of a scale provided on the cover as will be described later. 19 is a support plate for supporting an electrical connection section to the head cartridge 9. Numeral 21 is a flexible cable for connecting its electrical connection section to a control section of main body.

Numeral 23 is a guide shaft for guiding the carriage 11 in the S direction, which is inserted through bearings 25 of the carriage 11. Numeral 27 is a timing belt for transmitting the power to move the carriage 11 secured thereto in the S direction, looped under tension about pulleys 29A, 29B disposed on both side portions of the apparatus. A driving force is transmitted to one pulley 29B via a transmission, e.g. a gear, by a carriage motor 31.

Figure 3A:
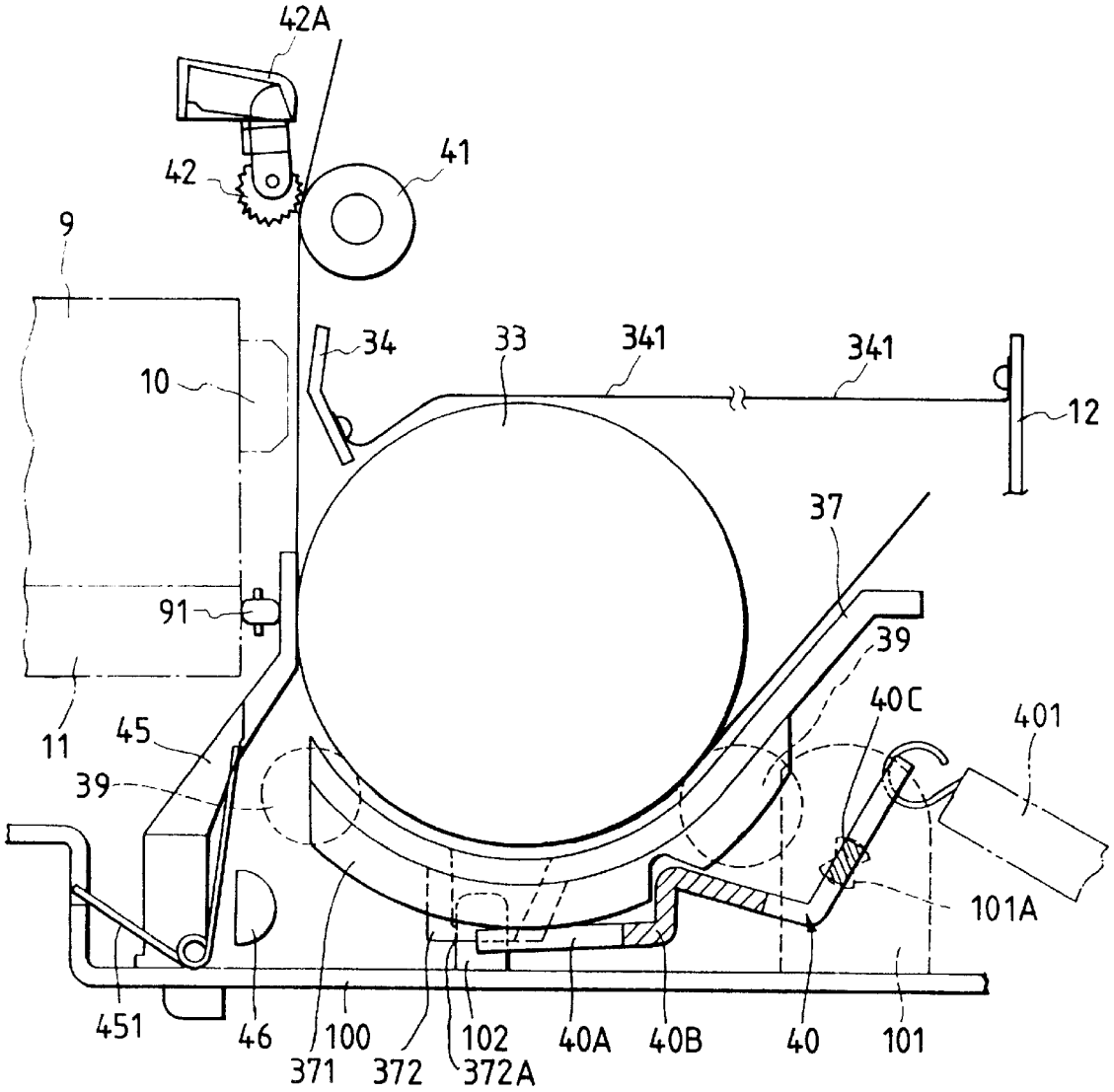
FIGS. 3A and 3B are a side cross-sectional view and an exploded upper view of a recording medium conveying system in the printer as shown in FIG. 2.

Numeral 33 is a conveying roller for conveying a recording medium, e.g. a paper in recording, as well as regulating a record plane of the recording medium, and which is driven by a conveying motor 35; 37 is a paper pan as a conveyance passage forming member for conducting the recording medium from the paper feed tray 4 to a recording position; 39 is a feed roller, disposed on the way of conveyance passage for the recording medium, for pressing the recording medium against the conveying roller 33 and conveying it. Numeral 34 is a platen, made of metal, e.g., iron or steel, for defining a recording face of recording medium, opposed to a discharge port face of the head cartridge 9, and which is provided opposed to a back side of recording medium conveyed by conveying means such as the conveying roller 33, opposed to the discharge port face. A part of the platen 34 has one end of a conductive wire 341 for grounding the platen 34 screwed as shown in FIG. 3A, while the other end of the conductive wire 341 is screwed to a part of a frame 12 disposed in a standing position as shown in FIGS. 2 and 3A. Thereby, the platen 34 is electrically grounded, so that the disordered flying of ink droplets can be eliminated. Also, the platen 34 serves mainly as a paper guide member in the apparatus of this example. Numeral 41 is a paper exhausting roller for exhausting the recording medium to a paper exhausting port, not shown, which is disposed downstream from the recording position in the direction of conveying the recording medium. Numeral 42 is a spur provided correspondingly to the paper exhausting roller 41, for pressing the paper exhausting roller 41 via the recording medium, and yielding a force for conveying the recording medium with the paper exhausting roller 41.

Numeral 43 is a release lever for releasing the engagement between a feed roller 39, a presser bar 45 and the spur 42 in setting the recording medium.

Numeral 45 is the presser bar for suppressing the floating of the recording medium in the neighborhood of recording position to secure a close contact state against the conveying roller 33. In this example, an ink jet recording head for recording with the discharge of ink is used as the recording head. Accordingly, as the distance between the ink discharge port formation face of recording head and a record surface of recording medium is relatively slight, and must be strictly controlled to avoid a contact between the recording medium and the discharge port formation face, it is effective to dispose the presser bar 45. Numeral 47 is a scale provided on the presser bar 45, and 49 is a marker provided on the carriage 11 corresponding to this scale, both of them enabling a print position or a set position for the recording head to be read.

Numeral 51 is a cap made of an elastic material, e.g. rubber, which is opposed to the ink discharge port formation face of recording head placed at a home position, and supported to be able to attach to/detach from the recording head. The cap 51 is used for protecting the recording head when not used, or in a suction recovery processing for the recording head.

The suction recovery process is one in which with the cap 51 placed opposed to the discharge port formation face, the ink is discharged through all discharge ports by driving energy generation elements provided inwardly of the ink discharge ports and used to discharge the ink, thereby to remove discharge faulty factors such as air bubbles or dusts, or thickened ink unsuitable for recording (predischarge), and apart from that, with the discharge port formation face being covered with the cap 51, the ink is forcedly discharged, thereby to remove discharge faulty factors.

Numeral 53 is a pump used to exert a suction force for the forced discharge of ink, and to such the ink received within the cap 51 in performing the suction recovery process with such forced discharge or predischarge of ink; 55 is a waste ink tank for reserving waste ink sucked by the pump 53, and 57 is a tube communicating the pump 53 to the waste ink tank 55.

Numeral 59 is a blade for wiping the discharge port formation face of the recording head, which is supported to be movable between a position for wiping with the movement of head which projects onto the recording head, and a retracted position not engaging the discharge port formation face.

Numeral 61 is a motor, and 63 is a cam mechanism for driving the pump 53 and moving the cap 51 and the blade 59, with the power transmitted from the motor 61.

FIG. 3A is a typical side view showing mainly a recording medium conveying system of the apparatus as shown in FIG. 2.

FIG. 3A shows the arrangement of each element in the ordinary conveying of recording medium. The recording medium fed from the paper feed tray, not shown, is introduced into the conveyance passage formed between the conveying roller 33 and the paper pan 37. In this conveyance passage, when the conveying roller 33 is rotated in a clockwise direction as shown, the recording medium is conveyed, with a frictional force between the conveying roller 33 and the recording medium based on a pressing force of the feed roller 39. Thereafter, the recording medium is introduced between the conveying roller 33 and the paper presser bar 45, and is also conveyed, with a frictional force between the conveying roller 33 and the recording medium based on a pressing force of the paper presser bar 45. Further, the recording medium is regulated in its direction by the paper presser bar 45, and conveyed along the platen 34 between the paper exhausting roller 41 and the spur 42, during which the recording is made onto the recording medium by discharging ink droplets from the recording head 10 mounted on the recording head cartridge 9.

Figure 3B:
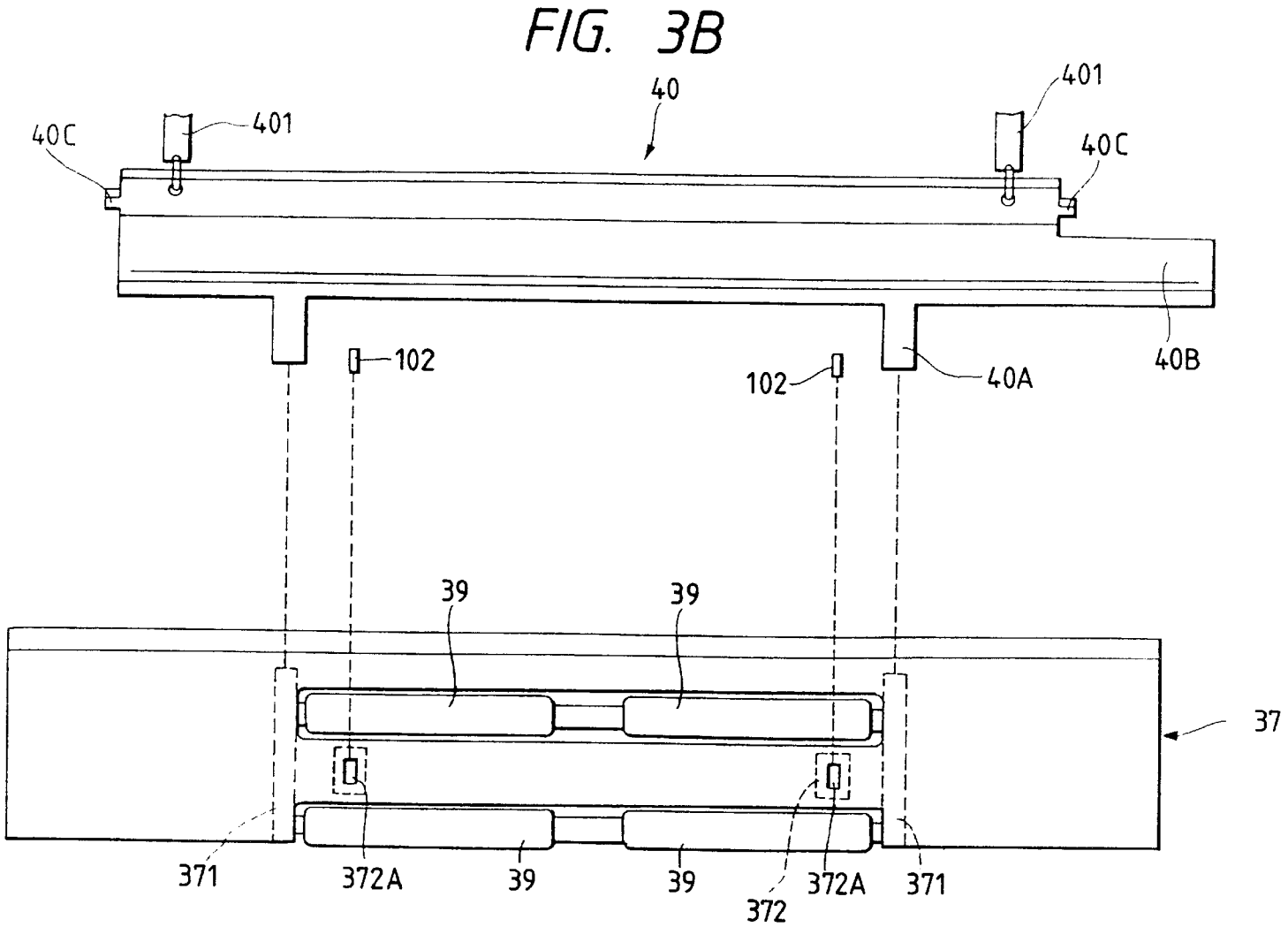

FIG. 3B is a view showing the paper pan 37 and a release plate 40 for urging it in a direction toward the conveying roller 33, as viewed from above, wherein they are shown separated for the explanation. Here, the paper pan 37 for paper conveyance is formed of a synthetic resin such as polycarbonate.

Referring to FIGS. 3A and 3B, the mechanism for conveying the recording medium will be described below. In these figures, 40 is the release plate for biasing the feed roller against the conveying roller 33 via the paper pan 37, and for releasing the biasing. That is, the release plate 40 is rotatably supported around shanks 40C provided at both ends which engage shank holes 101A provided on release plate supporting members 101 disposed in the standing position in a bottom plate 100 of the apparatus. As a result, if the release plate 40 is urged obliquely right downward by springs 401 engaging two positions at one end of the release plate 40, the release plate 40 is rotated clockwise around the shanks 40C as the fulcrum, as shown in FIG. 3A. Numeral 371 denotes ribs provided at two locations underneath the paper pan 37. The ribs 371 are brought into contact with the pressing portion 40A during the above rotation of the release plate 40, and pressed upwardly in FIG. 3A. Thereby the feeder roller 39 which bears on the ribs 371 presses the conveying roller 33.

The release of pressing force with the release plate 40 is performed in such a way that a shoulder 40B extending at one end of the release plate 40 is pressed downwardly in FIG. 3A against the rotation force owing to a spring 401. If this pressing force is released, the paper pan 37 and the feed roller 39 move downwardly by their own weights, thereby providing a predetermined amount of space between the feed roller 39 and the conveying roller 33.

Numeral 372 is a rectangular projection portion formed when a portion of the paper pan 37 extends downwardly. In the projection portion 372 is provided a rectangular hole 372A, which engages a projection 102 upstanding on the bottom plate 100 with a predetermined amount of looseness. With this engagement, the positioning of the paper pan 37, and hence for feed roller 39 with respect to the conveying roller 33 can be performed.

Numeral 451 is a spring for forcing the paper presser bar 45 in the direction toward the platen 33.

The spring 451 has one end thereof extending from a coil-shaped portion engaged with a portion of the paper presser bar 45, and the other end engaged with a portion of the bottom plate 100 of the mechanism. The coil-shaped portion bears on a portion of the bottom plate 100. The paper presser bar 45 is also pressed via a roller 91 provided on a leading end portion of the carriage 11 by the carriage 11, as will be described later. The distance between discharge ports provided on the recording head 10 of the head cartridge 9 and a recording surface of the recording medium can be properly maintained by the pressing force of the paper presser bar 45 via the roller 91 and the spring 451.

The paper presser bar 45 also exerts the pressing force on the conveying roller 33 via the recording medium due to the pressing force as above described, thereby conveying the recording medium with a friction force between the recording medium and the conveying roller 33 based on that pressing force.

Here, to convey successfully various types of recording media, it is requisite to make appropriate the friction force between the paper presser bar and the recording medium, and between the conveying roller and the recording medium, respectively. That is, as the paper presser bar and the recording medium may slide relative to each other, it is desirable that the friction force therebetween be as small as possible, while the friction force between the conveying roller and the recording medium is as large as possible, as the conveying roller must convey the recording medium closely in contact therewith.

Also, it is desirable that the friction force between the paper presser bar and the conveying roller be as small as possible. This is because if that friction force is large, the motor load becomes large when making the so-called idle feeding. If a predetermined amount of gap is provided between the paper presser bar and the conveying roller to avoid it, the precision control in urging the recording medium against the platen becomes difficult.

Hence, in this example, the material of the paper presser bar 45 is polyacetal (POM), and that of the conveying roller 33 is chloroprene rubber (CR, hardness 60° /A scale) mixed with 5–10% (weight ratio) of monofilament of nylon resin. Fluororesin can be also used for the paper presser bar 45. When a synthetic resin such as POM is used for the paper presser bar 45 as above, the static electricity is likely to occur with the recording medium, whereby the recording medium is charged, causing a problem that ink droplets may be disordered in its flying direction. To resolve the problem, this example of the present invention makes use of an advantage that the paper presser bar formed of POM has a small friction force, and aims to eliminate the disordered flying problem of ink droplets by electrically connecting the platen 34 to the grounded frame 12 (or chassis).

It should be noted that the hardness of above mentioned chloroprene rubber was 60°, but if it is within a range between 50° and 70°, it does not have an adverse effect on the conveyance of the recording paper. It is not necessary that the conveying roller 33 and the paper presser bar 45 are entirely made of the above materials, only direct contact portions may be constructed of above materials, or further the paper presser bar and the conveying roller can be formed by pasting a sheet member of above material onto the body portion.

As the friction coefficient between the paper presser bar 45 and the recording medium can be reduced by constructing the paper presser bar and the conveying roller with above materials, the constitution that the paper presser bar 45 presses against the conveying roller 33 can be embodied as described above. Consequently, the distance between the recording medium and the head cartridge can be controlled more easily than a previous constitution which did not allow for the recording medium of various thicknesses. As the friction coefficient between the recording medium and the conveying roller is larger, a slide does not occur during the conveyance, whereby the successful conveyance of the recording medium can be accomplished.

In FIG. 3A, 46 is a shaft member extending parallel to the paper presser bar 45, with both ends thereof bearing on a frame of the device, its cross-section having a D character shape. When the recording medium is conveyed, the rotation position is determined so that a straight portion of D character is placed in a longitudinal direction (upper to lower direction in the same figure). On the other hand, when the pressing force of the paper presser bar 45 against the conveying roller 33 is released, its straight portion is directed transversely (left to right direction in FIG. 3A) so as to come into contact with a portion of the spring 451, so that the spring is displaced, thereby releasing the engagement between the spring 451 and the paper presser bar 45. Thus, the pressing force is only released without changing the position of the paper presser bar 45.

Consequently, even if the carriage 11 is operated with the pressing force being released because of the insertion of a recording medium, the head cartridge and the carriage do not interfere with the paper presser bar to thereby damage the head cartridge and the carriage. In other words, it is possible to perform various operations by moving the carriage, even while the pressing force of the paper presser bar is being released. The pressing force against the paper presser bar 45 via the roller 91 is not released in this case, but this pressing force is directed to one point of a portion where the paper presser bar 45 is opposed to the carriage 11, and so it does not have any problem for inserting the recording medium.

In FIG. 3A, 41 is a paper exhausting roller, with which a spur 42 engages. The spur 42 is urged toward the paper exhausting roller 41 by urging means, in which the recording medium can be also conveyed with the friction force between the recording medium and the paper exhausting roller 41, based on that pressing force as previously described. The spur 42 is urged via a holding member 42A toward the paper exhausting roller 41 as above described, and detached from the paper exhausting roller 41 via the holding member 42A, thereby releasing the engagement therewith.

Figure 3C:
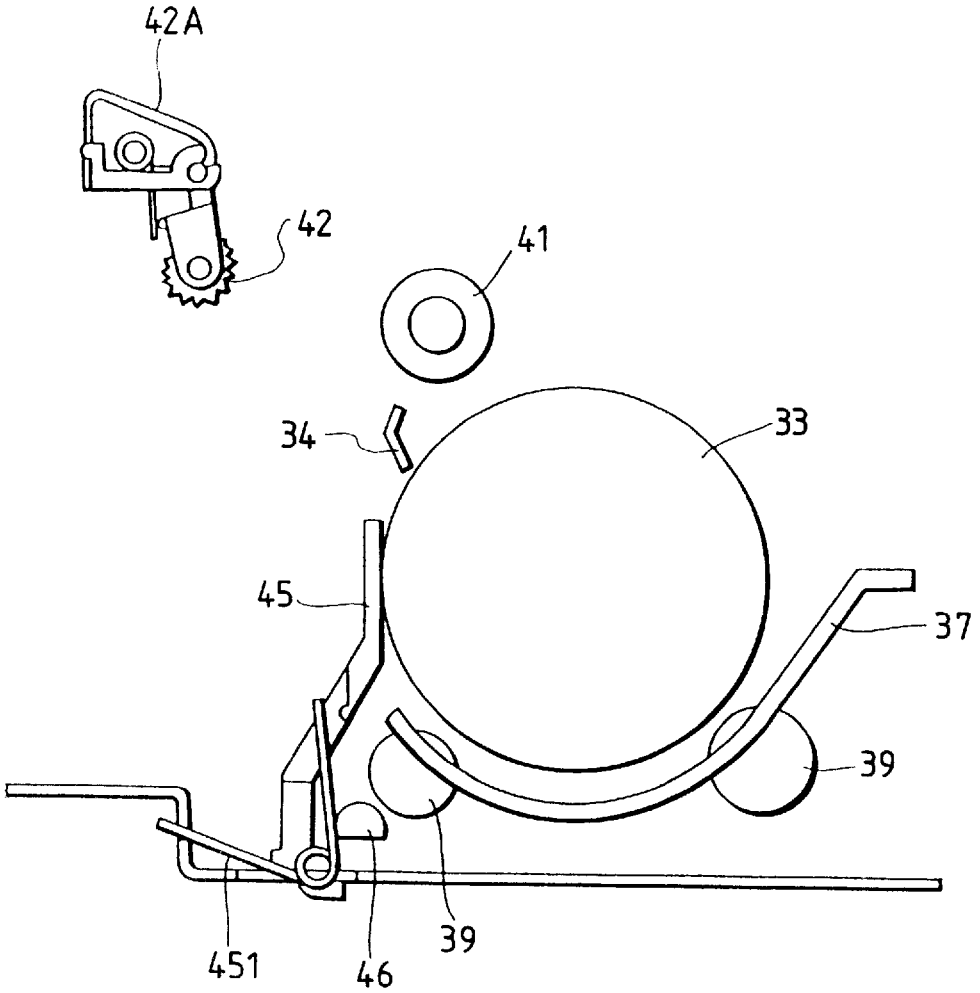
FIG. 3C is a side cross-sectional view showing a state where each urging force is disengaged in the above conveying system.

As described above, the paper pan 37 (feed roller 39), the paper presser bar 45 and the spur 42 as shown in FIGS. 3A and 3B can release their urging forces in respective forms. The releasing can be performed simultaneously by the operation of a release lever 43 as shown in FIG. 2, resulting in the state as shown in FIG. 3C.

As above described, in this example, there are some cases where the recording medium may be charged with electricity, owing to a friction between the paper pan 37 and the recording medium, and between the paper presser bar 45 and the recording medium, which is more remarkable at a lower temperature and a lower humidity. Here, by electrically earthing (grounding) the platen on a back side of recording medium, the flying of ink droplets discharged onto the recording medium under the influence of the above charge can be prevented from disordering, resulting in a normal recording. Then, the position of the platen 34 is 0 to 1 mm, preferably, about 0.5 mm, away from a back face of recording medium and it is known that the platen should be positioned near the recording position.

In the above example, the so-called frame ground is used in which the platen 34 is electrically connected to a grounded frame 12 of the recording apparatus, but when a three-phase power source is used, for example, it can be connected to one ground thereof. Also, it can be connected to GND of a transformer. Or it can be electrically connected to a chassis mounting a circuit substrate. In this case, the chassis is grounded, and therefor, the platen is also grounded. The platen 34 is not necessarily grounded, but predetermined effects of the present invention can be also obtained by setting it at a predefined voltage lower than the potential formed by a charged recording medium in the neighborhood of discharge ports in the recording head 10.

Also, as shown in FIG. 2, a support member 32 for supporting both ends of the platen 34, made of metal, can be integrated with a metallic frame of the recording apparatus or screwed to the frame 12, so that the platen 34 and the frame 12 are placed in an electrically conductive state without any conductive wire 341, and the platen 34 can be grounded electrically.

Also, the member to be grounded in the neighborhood of discharge ports is not necessarily the platen. That is, a new member for ground can be provided at the position opposed to the discharge ports of the recording head, or another member of the apparatus extending corresponding to a recording area with the recording head, for example, a portion of the presser bar 45 or the paper pan 37, can be utilized as an earth member. By the way, in the examination of earthing an aluminum foil extending in a longitudinal direction on an upper portion of the presser bar 45, instead of earthing the platen, it was indicated that the flying of ink droplets could be prevented from disordering, and thus a stable normal recording could be performed.

Also, it is conceived that a static eliminating brush grounded and provided separately can be placed in contact with the recording medium.

Note that in the present invention, the absolute value of the potential of a conductive member, such as a platen, is held to be lower than that of the recording medium which is charged due to a friction with conveying means. Also, in the present invention, the conductive member such as platen is set to be positioned in proximity of the ink discharge portion of the recording head. The proximity positional relation means that the distance between the conductive member such as platen and the ink discharge portion of the recording head is large enough to yield the action effects of the present invention, or to eliminate the disordered flying of ink droplets under the influence of charged recording medium.

Also, in the present invention, by holding the potential of the conductive member at a reference voltage of the ink jet recording apparatus, the action effects aimed by the present invention can be fulfilled.

While in the above example, the reference voltage is made at 0V by connecting electrically the platen which is a conductive member to the grounded frame, it should be noted that the present invention is not limited to such a form, but the same effects can be also obtained by using the reference voltage, e.g., at 5V, useful for driving a motor within the recording apparatus.

It can be mentioned that the feature of the present invention resides in eliminating static electricity from a recording area of charged recording medium by providing static eliminating means at a position in proximity of the ink discharge portion of the recording apparatus. One example of this static eliminating means is the grounded platen as above described. In short, the static eliminating means is applicable to the present invention, as long as it is capable of eliminating static electricity from the recording area of recording medium, irrespective of its form.

Note that in the present invention, static eliminating means includes one as reducing the amount of charge in the recording area of recording medium to a degree enough to prevent the improper print or irregularities of density.

In the above example, as the platen is used as a conductive member, the conductive member is provided opposed to a back side of a face of recording medium conveyed by conveying means opposed to the ink discharge portion of the recording head, whereas in the present invention, the position of the conductive member is not limited to the above position, but it may be provided on a face side opposed to the ink discharge portion of recording head among the front and back sides of recording medium.

(Experimental example)

A comparative experiment was performed to confirm the effects of the present invention. The results are shown in the following.

An ink jet recording apparatus as described in the previous example and shown in FIGS. 2 and 3 was fabricated, and three kinds of recording sheets (21 cm×29.5 cm in size) were fed into a main body of the recording apparatus from a paper feed tray, whether or not there were improper print results was judged for the cases where a conductive wire 341 was provided as the ground wire, and where it was not provided, respectively.

Note that three kinds of recording sheets were prepared, and the experiment was performed by feeding sheets for each kind in the cases where the conductive wire 341 as the ground wire was provided, and where it was not provided, respectively. During the experiment, the air temperature was 15° C., and the humidity was 20%. The results are shown in Table 1. Note that numerals in Table 1 indicate the number of recording sheets corresponding to each column.

TABLE 1

| | No conductive wire | | | conductive wire | | |
|---|---|---|---|---|---|---|
| Sheet | ◎ | ○ | x | ◎ | ○ | x |
| Dry copy paper made by CANON INC. (64 g/m$^2$, 95 $\mu$m thick) | 0 | 0 | 20 | 20 | 0 | 0 |
| T21 made by LIFE (66.2 g/m$^2$, 77.2 $\mu$m thick) | 11 | 4 | 5 | 17 | 3 | 0 |
| BAND BOND made by Fuji Photo Film Co., Ltd. (61.2 g/m$^2$, 88 $\mu$m thick) | 10 | 10 | 0 | 17 | 3 | 0 |

In Table 1, the evaluation is indicated at three stages of ◎, ○ and x, and its contents are as follows.

◎. . . No improper print is recognizable. ○. . . More or less improper print is recognizable, but almost indistinguishable.

x . . . Improper print is recognizable.

As can be clearly seen from the above explanation, according to the present invention, the flying of ink discharged from the recording head is stabilized, so that disordered recording positions on the recording medium can be avoided.

As a result, the improper shape of character or image due to disordered recording positions or irregular densities can be prevented, and a high quality of print image can be provided.

The present invention brings about excellent effects particularly in a recording device of the ink jet method in which the recording is performed by forming minute liquid droplets by the use of the heat energy among the various ink jet recording systems.

As to its representative constitution and principle, for example, one practiced by use of the basic principle disclosed in, for example, U.S. Pat. Nos. 4,723,129 and 4,740,796 is preferred. This system is applicable to either of the so-called on-demand type and the continuous type. Particularly, the case of the on-demand type is effective because, by applying at least one driving signal which gives rapid temperature elevation exceeding nucleate boiling corresponding to the recording information on electricity-heat converters arranged corresponding to the sheets or liquid channels holding liquid (ink), heat energy is generated at the electricity-heat converters to effect film boiling at the heat acting surface of the recording head, and consequently the bubbles within the liquid (ink) can be formed corresponding one by one to the driving signals. By discharging the liquid (ink) through an opening for discharging by growth and shrinkage of the bubble, at least one droplet is formed. By making the driving signals into pulse shapes, growth and shrinkage of the bubble can be effected instantly and adequately to accomplish more preferable discharging of the liquid (ink) particularly excellent in response characteristic.

As the driving signals of such pulse shape, those as disclosed in U.S. Pat. Nos 4,463,359 and 4,345,262 are suitable. Further excellent recording can be performed by employment of the conditions described in U.S. Pat. No. 4,313,124 of the invention concerning the temperature elevation rate of the above-mentioned heat acting surface.

As the constitution of the recording head, in addition to the combination constitutions of discharging orifice, liquid channel, electricity-heat converter (linear liquid channel or right angle liquid channel) as disclosed in the above-mentioned respective specifications, the constitution by use of U.S. Pat. Nos. 4,558,333, and 4,459,600 disclosing the constitution having the heat acting portion arranged in the flexed region is also included in the present invention.

In addition, the present invention can be also effectively made the constitution as disclosed in Japanese Laid-Open Patent Application No. 59-123670 which discloses the constitution using a slit common to a plurality of electricity-heat converters as the discharging portion of the electricity-heat converter or Japanese Laid-Open patent application Ser. No. 59-138461 which discloses the constitution having the opening for absorbing pressure waves of heat energy correspondent to the discharging portion.

Further, as the recording head of the full line type having a length corresponding to the maximum width of recording medium which can be recorded by the recording device, either the constitution which satisfies its length by combination of a plurality of recording heads as disclosed in the above-mentioned specifications or the constitution as one recording head integrally formed may be used.

In addition, the present invention is effective for a recording head of the freely exchangeable chip type which enables electrical connection to the main device or supply of ink from the main device by being mounted on the main device, or for the case by use of a recording head of the cartridge type having an ink tank provided integrally on the recording head itself.

Also, addition of a restoration means for the recording head, a preliminary auxiliary means, etc. is preferable, because the effect of the present invention can be further stabilized. Specific examples of these may include, for the recording head, capping means, cleaning means, pressurization or aspiration means, electricity-heat converters or other heating elements or preliminary heating means according to a combination of these, and it is also effective for performing stable recording to perform preliminary mode which performs discharging separate from recording.

Further, as the recording mode of the recording device, the present invention is extremely effective for not only the recording made only of a primary color such as black etc., but also a device equipped for recording with at least one of plural different colors or full color by color mixing, whether the recording head may be either integrally constituted of combined in plural numbers.

Although the ink is considered as the liquid in the examples of the present invention as described above, the present invention is applicable to the ink solidifying at or being below room temperature, and liquefying or liquid at the room temperature, or the ink liquefying when a recording enable signal is issued, as the viscosity of ink is generally controlled to be maintained within a certain range for stable discharge by adjusting the temperature of ink in a range from 30° C. to 70° C. in the above ink jet method.

In addition, in order to avoid the temperature elevation due to the heat energy by positively utilizing it as the energy for the change of state of ink from solid to liquid, or to prevent the evaporation of ink by keeping the ink solid in the shelf state, the ink having a property of becoming liquid only with the application of heat energy can be used. Such ink can be used as the discharge liquid since it liquefies with the application of heat energy in accordance with a recording signal or solidifies upon reaching a recording medium, and is thus also applicable to the present invention. In this case, the ink may be in the form of being held in recesses or through holes of a porous sheet as liquid or solid matter, and opposed to electricity-heat converters, as described in Japanese Laid-Open Patent Application No. 54-56847 or Japanese Laid-Open Patent Application No. 60-71260. The most effective method for inks as above described in the present invention is one based on the film boiling as above indicated.

Further, the form of the recording device according to the present invention, in addition to being provided integrally or separately as an image output terminal for the information processing equipment such as a computer or word processor, can be embodied as a copying machine in combination with a reader, and further, a facsimile terminal equipment having the transmission and reception feature.

Figure 4:
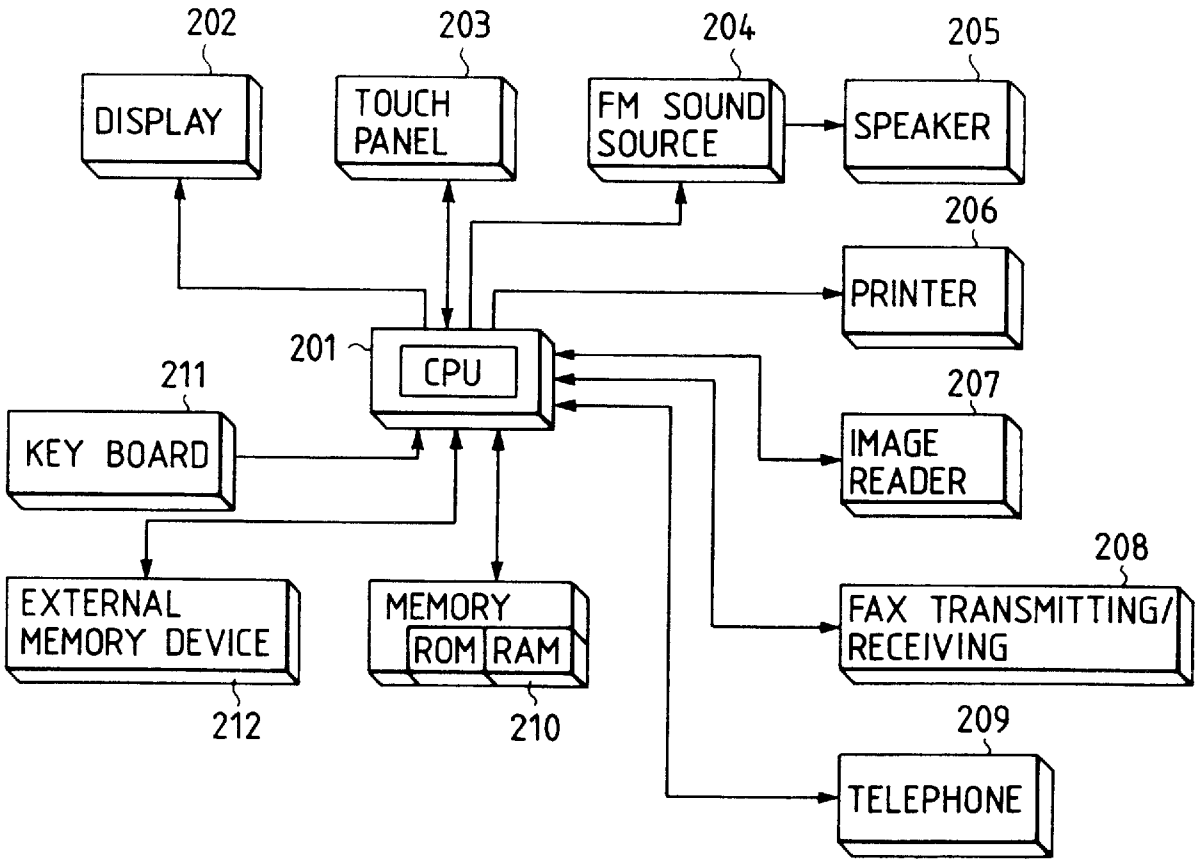
FIG. 4 is a block diagram showing a schematic configuration when a recording apparatus of the present invention is applied to an information processing unit.

FIG. 4 is a block diagram showing a schematic configuration in which an ink jet recording apparatus of the present invention is applied to the information processing apparatus having the feature of word processor, personal computer, facsimile terminal equipment, copying machine, and electronic typewriter.

In the figure, 201 is a control unit for controlling the whole apparatus, wherein it comprises a CPU such as a microprocessor or with various I/O ports, and controls by outputting or inputting control or data signals to or from each of sections, respectively, and 202 is a display section, which displays various menus, document information, and image data read with an image reader 207 on the display screen. Numeral 203 is a transparent, pressure sensitive touch panel provided on the display section 202, which enables the entry of items or coordinate values on the display section 202 by depressing its surface with a finger or the like.

Numeral 204 is a FM (Frequency Modulation) sound source section, which makes the FM modulation by storing the music information created with a music editor in a memory 210 and an external storage device 212 as the digital data and reading data from the memory or external storage device. An electrical signal from the FM sound source section 204 is converted into an audible sound by a speaker section 205. A printer section 206 is one to which the present invention is applied, as the output terminal for a word processor, personal computer, facsimile terminal equipment, or copying machine.

Numeral 207 is an image reader section which inputs original data by reading it photoelectrically, and is provided midway on the conveying path of the original to read facsimile or to copy the original, and other various types of originals. Numeral 208 is a facsimile (FAX) transmission or reception section for transmitting original data read by the image reader section 207 with the facsimile or receiving and decoding facsimile signals that are transmitted, having an interface facility with the outside. Numeral 209 is a telephone section, comprising various telephone features, such as ordinary telephone function or automatic answering telephone function.

Numeral 210 is a memory section comprising a ROM for storing system programs, manager programs and other application programs, character fonts, and dictionary, as well as application programs loaded from the external storage device 212, document information, and a video RAM.

Numeral 211 is a keyboard section for inputting document information or various commands.

Numeral 212 is the external storage device, which is a floppy disk or hard disk as the storage medium, used to store document information, music or audio data, and user's application programs.

Figure 5:
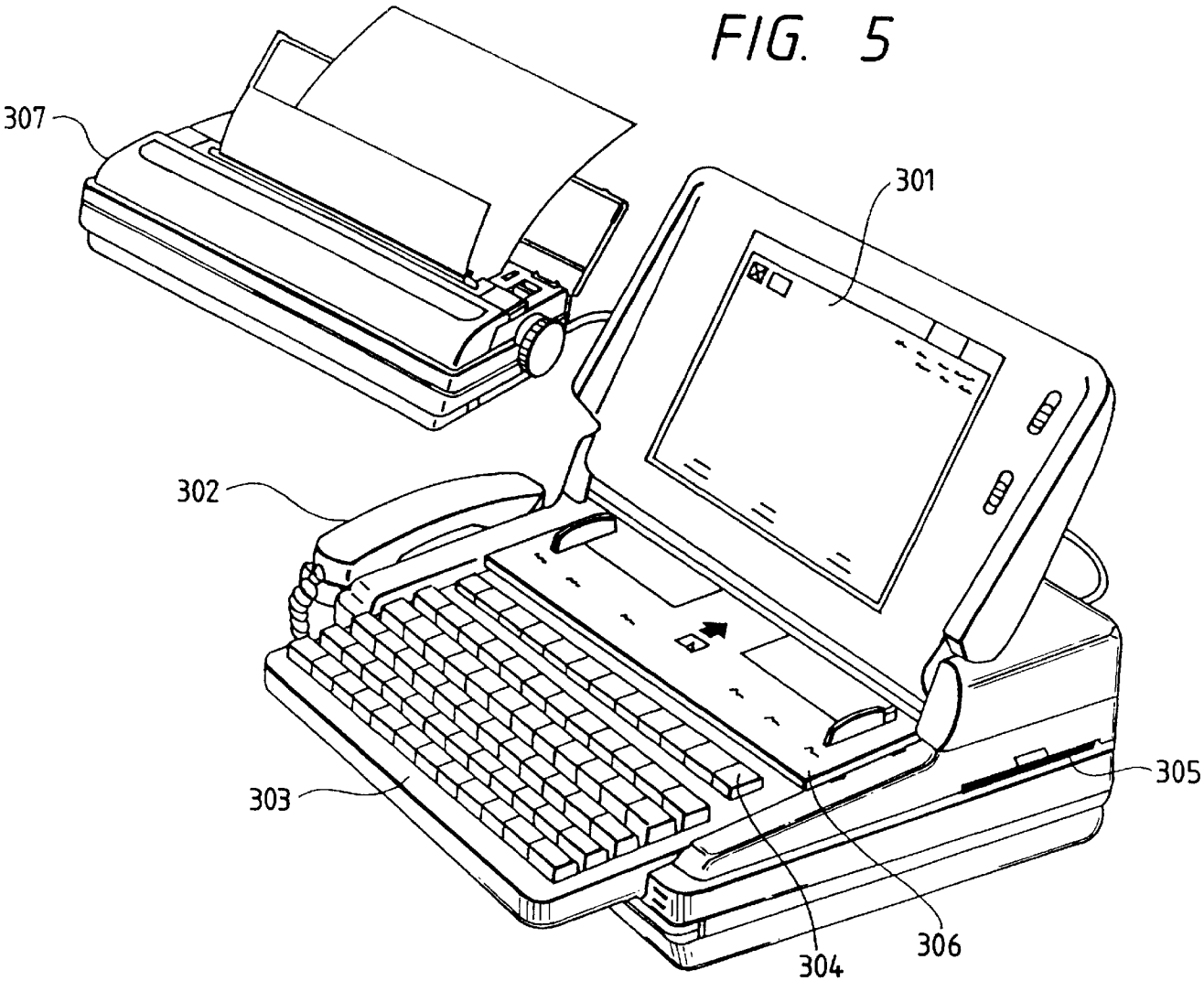
FIG. 5 is an external view of the information processing unit as shown in FIG. 4.

FIG. 5 is an external view of the information processing apparatus as shown in FIG. 4.

In the figure, 301 is a flat panel display using a liquid crystal, for displaying various menus, graphic data or document information. On this display 301 is installed the touch panel 203 as previously described, which enables the entry of coordinates or item specifications by depressing a surface of the touch panel 203 with a finger or the like. Numeral 302 is a handset to be used when the apparatus functions as a telephone.

The keyboard 303 is detachably connected via a cord to the main body, and is used to input various kinds of document information or data. The keyboard 303 is also provided with various types of function keys 304. Numeral 305 is an opening for insertion of the floppy disk into the external storage device 212.

Numeral 307 is a paper setting board for laying a paper to be read by the image reader section 207, in which a read original is exhausted from a rear portion of device. In the facsimile reception, it is recorded by an ink jet printer 307.

The display section 202 as shown in FIG. 4 may be CRT, but is preferably a flat panel of liquid crystal display using a ferroelectric liquid crystal. This is because it can be more compact, thinner, and lighter.

When the above mentioned information processing unit is operated as a personal computer or word processor, various kinds of information input from the keyboard 211 are processed according to a predetermined program in the control section 201, and output to the printer section 206 as images.

When it is operated as a receiver for the facsimile terminal equipment, the facsimile information input from the FAX transmission and reception section 208 via the transmission line are received and processed according to a predetermined program in the control section 201, and output to the printer section 206 as a received image.

And when it is operated as a copying machine, an original is read by the image reader section 207, and read original data is output via the control section 201 to the printer section 206 as a copied image. Note that it is operated as a transmitter for the facsimile terminal equipment, original data that was read by the image reader section 207 is processed for transmission according to a predetermined program in the control section 201, and transmitted via the FAX transmission and reception section 208 to the transmission line.

Figure 6:
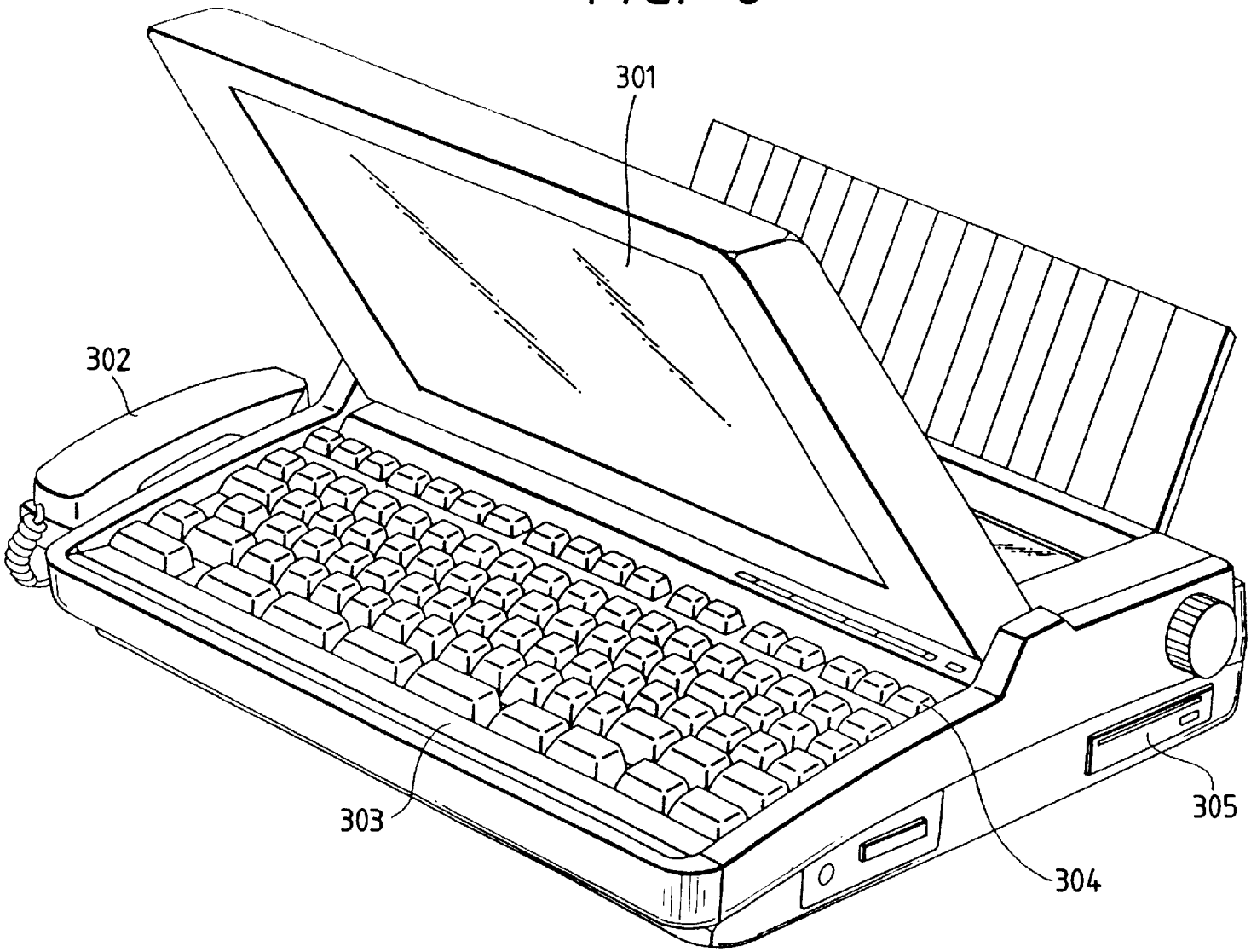
FIG. 6 is an external view showing another example of an information processing unit.

It should be noted that the above mentioned information processing device can be constituted as the integral type having an ink jet printer contained within the main body, as shown in FIG. 6, in which its portability can be enhanced. In the same figure, like reference numerals are affixed to parts having the same functions as those in FIG. 5.

As a higher quality of recording image can be obtained by applying a recording apparatus According to the present invention to the multifunction information processing device as above described, the function of the information processing device can be further improved.

I claim:

1. An ink jet recording apparatus for recording onto a recording medium by discharging ink, said apparatus comprising:

conveying means for conveying the recording medium to a position opposed to an ink discharge portion of a recording head for discharging the ink, while being in contact with the recording medium, said conveying means including a conveying roller for conveying the recording medium, a paper presser bar for abutting said conveying roller, and a conveyance passage forming member for forming a conveyance passage for the recording medium;

a platen for defining a record face of the recording medium, said platen being disposed at a position corresponding to the recording area of the recording medium opposed to the recording head; and means for reducing an electrical charge amount of a recording area of the recording medium, the recording medium being electrically charged, by grounding so as to reduce a disturbance of a recording position of ink discharged from said recording head, said reducing means being electrically conductive and electrically connected to said platen, wherein the potential of said reducing means is held at a constant voltage, and an absolute value of a potential of said reducing means is less than an absolute value of a potential of the electrically charged recording medium which is conveyed by said conveying means.

2. The ink jet recording apparatus according to claim 6, wherein a spacing between said platen and a back face of the recording medium is 0 to 1 mm.

3. The ink jet recording apparatus according to claim 1, wherein said paper presser bar is formed of a synthetic resin.

4. The ink jet recording apparatus according to claim 3, wherein said paper presser bar is formed of polyacetal.

5. The ink jet recording apparatus according to claim 1, wherein said conveyance passage forming member is formed of a synthetic resin.

6. The ink jet recording apparatus according to claim 5, wherein said conveyance passage forming member is formed of polycarbonate.

7. The ink jet recording apparatus according to claim 1, wherein said recording head is a recording head for discharging the ink by the use of heat energy, comprising electricity-heat converters for generating the heat energy to be applied to the ink.

8. The ink jet recording apparatus according to claim 1, wherein said recording head discharges the ink through discharge ports by the use of pressure variation caused by growth and shrinkage of bubbles due to the film boiling which is produced by the heat energy applied by said electricity-heat converters.

9. An image forming apparatus for forming an image on a recording medium by discharging ink, comprising:

conveying means for conveying the recording medium to a position opposed to an ink discharge portion of a recording head for discharging the ink, while being in contact with the recording medium;

means for reducing an electrical charge amount of a recording area of the recording medium, the recording medium being electrically charged, by grounding so as to reduce a disturbance of a recording position of ink discharged from said recording head, said reducing means being electrically conductive, wherein the potential of said reducing means is held at a constant voltage, and an absolute value of a potential of said reducing means is less than an absolute value of a potential of the electrically charged recording medium which is conveyed by said conveying means, and wherein said reducing means comprises a platen for defining a record face of the recording medium, and said platen is disposed only at a position corresponding to the recording area of the recording medium opposed to the recording head;

an image reader section for reading image data;

a display section for displaying image data read by said reader section; and a control section for controlling said conveying means, said reducing means, said image reader section and said display section.

10. An image forming apparatus for forming an image on a recording medium by discharging ink, comprising:

conveying means for conveying the recording medium to a position opposed to an ink discharge portion of a recording head for discharging the ink, while being in contact with the recording medium;

means for reducing an electrical charge amount of a recording area of the recording medium, the recording medium being electrically charged, by grounding so as to reduce a disturbance of a recording position of ink discharged from said recording head, said reducing means being electrically conductive, wherein the potential of said reducing means is held at a constant voltage, and an absolute value of a potential of said reducing means is less than an absolute value of a potential of the electrically charged recording medium which is conveyed by said conveying means, and wherein said reducing means comprises a platen for defining a record face of the recording medium, and said platen is disposed only at a position corresponding to the recording area of the recording medium opposed to the recording head;

an image reader section for reading image data; and a control section for controlling said conveying means, said reducing means and said image reader section.

11. An image forming apparatus for forming an image on a recording medium by discharging ink, comprising:

conveying means for conveying the recording medium to a position opposed to an ink discharge portion of a recording head for discharging the ink, while being in contact with the recording medium;

means for reducing an electrical charge amount of a recording area of the recording medium, the recording medium being electrically charged, by grounding so as to reduce a disturbance of a recording position of ink discharged from said recording head, said reducing means being electrically conductive, wherein the potential of said reducing means is held at a constant voltage, and an absolute value of a potential of said reducing means is less than an absolute value of a potential of the electrically charged recording medium which is conveyed by said conveying means, and wherein said reducing means comprises a platen for defining a record face of the recording medium, and said platen is disposed only at a position corresponding to the recording area of the recording medium opposed to the recording head;

an image reader section for reading image information;

a transmission and reception section for transmitting and receiving image information; and a control section for controlling said conveying means, said reducing means, said image reader section and said transmission and reception section.

12. An image forming apparatus for forming an image on a recording medium by discharging ink, comprising:

conveying means for conveying the recording medium to a position opposed to an ink discharge portion of a recording head for discharging the ink, while being in contact with the recording medium;

means for reducing an electrical charge amount of a recording area of the recording medium, the recording medium being electrically charged, by grounding so as to reduce a disturbance of a recording position of ink discharged from said recording head, said reducing means being electrically conductive, wherein the potential of said reducing means is held at a constant voltage, and an absolute value of a potential of said reducing means is less than an absolute value of a potential of the electrically charged recording medium which is conveyed by said conveying means, and wherein said reducing means comprises a platen for defining a record face of the recording medium, and said platen is disposed only at a position corresponding to the recording area of the recording medium opposed to the recording head;

recording data input means for inputting recording data; and head driving means for driving said recording head in response to the recording data.

13. The image forming apparatus according to claim 12, wherein said recording signal input means is a keyboard.

14. An information processing apparatus, comprising:

conveying means for conveying a recording medium to a position opposed to an ink discharge portion of a recording head for discharging ink, while being in contact with the recording medium;

means for reducing an electrical charge amount of a recording area of the recording medium, the recording medium being electrically charged, by grounding so as to reduce a disturbance of a recording position of ink discharged from said recording head, said reducing means being electrically conductive, wherein the potential of said reducing means is held at a constant voltage, and an absolute value of a potential of said reducing means is less than an absolute value of a potential of the electrically charged recording medium which is conveyed by said conveying means, and wherein said reducing means comprises a platen for defining a record face of the recording medium, and said platen is disposed only at a position corresponding to the recording area of the recording medium opposed to the recording head;

calculation processing means for processing data input from a source; and head driving means for driving said recording head in response to data processed by said calculation processing means.

15. An ink jet recording method using an ink jet recording apparatus, said method comprising the steps of:

positioning the recording medium to a position opposed to an ink discharge portion of an ink jet recording head for discharging ink;

reducing an electrical charge amount of a recording area of the recording medium, the recording medium being electrically charged, by grounding by providing reducing means contacting or positioned proximate to the recording medium, with the reducing means being electrically conductive and having a potential that is held at a constant value, and an absolute value of a potential of the reducing means is less than an absolute value of a potential of the electrically charged recording medium, wherein the reducing means comprises a platen for defining a record face of the recording medium, and the platen is disposed only at a position corresponding to the recording area of the recording medium opposed to the recording head; and discharging ink from the ink jet recording head to the recording area at which the electrical charge amount is reduced to reduce a disturbance of a recording position of ink discharged from the recording head.

16. A conveying apparatus for conveying a recording medium to be recorded by a recording head, said apparatus comprising:

conveying means for conveying the recording medium to a recording position of the recording head;

a platen for defining a record face of the recording medium, said platen being disposed at a position corresponding to a recording area of the recording medium opposed to the recording head; and grounding means for grounding said platen, wherein the recording medium is electrically charged and said grounding means reduces an absolute value of a potential of the electrically charged recording medium conveyed by said conveying means.

17. An apparatus according to claim 16, wherein said conveying means includes a conveying roller for conveying the recording medium, a paper presser bar for abutting the recording medium, and a conveying passage forming member for forming a conveyance passage for the recording medium.

18. An apparatus according to claim 17, wherein said conveying passage forming member is formed of a synthetic resin.

19. An apparatus according to claim 18, wherein said conveying passage forming member is formed of a polycarbonate.

20. An apparatus according to claim 17, wherein said paper presser bar is formed of a synthetic resin.

21. An apparatus according to claim 17, wherein said paper presser bar is formed of polyacetal.

* * * * *

UNITED STATES PATENT AND TRADEMARK OFFICE

CERTIFICATE OF CORRECTION

PATENT NO. : 5,854,648 Page 1 of 2

DATED : December 29, 1998

INVENTOR(S) : HANABUSA

It is certified that error appears in the above-identified patent and that said Letters Patent is hereby corrected as shown below:

On the title page, item:

[57] ABSTRACT:

Line 2, "discharging comprise" should read --discharging ink comprises--.

COLUMN 3:

Line 23, "has the function" should read --functions--.

COLUMN 8:

Line 67, "ground" should read --grounding--.

COLUMN 10:

Line 2, "tray, whether" should read --tray. Whether--.

COLUMN 13:

Line 64, "According" should read --according--.

UNITED STATES PATENT AND TRADEMARK OFFICE

CERTIFICATE OF CORRECTION

PATENT NO. : 5,854,648 Page 2 of 2

DATED : December 29, 1998

INVENTOR(S) : HANABUSA

It is certified that error appears in the above-identified patent and that said Letters Patent is hereby corrected as shown below:

COLUMN 14:

Line 30, "claim 6," should read --claim 1,--.

Line 48, "claim 1," should read --claim 7,--.

COLUMN 16:

Line 31, "signal" should read --data--.

COLUMN 18:

Line 21, "claim 17," should read --claim 20,--.

Signed and Sealed this

Seventh Day of September, 1999

*Attest:*

Q. TODD DICKINSON

*Attesting Officer*

*Acting Commissioner of Patents and Trademarks*